US006464183B1

(12) United States Patent
Bouhuijs

(10) Patent No.: US 6,464,183 B1
(45) Date of Patent: Oct. 15, 2002

(54) FORCE COMPENSATOR

(75) Inventor: Menno Cornelis Bouhuijs, Hengelo (NL)

(73) Assignee: Demcon Product Development Engineering (NL)

( * ) Notice: Subject to any disclaimer, the term of this patent is extended or adjusted under 35 U.S.C. 154(b) by 0 days.

(21) Appl. No.: 09/674,820

(22) PCT Filed: May 6, 1999

(86) PCT No.: PCT/NL99/00275

§ 371 (c)(1),
(2), (4) Date: Jan. 26, 2001

(87) PCT Pub. No.: WO99/56589

PCT Pub. Date: Nov. 11, 1999

(30) Foreign Application Priority Data

May 7, 1998 (NL) ..... 1009102

(51) Int. Cl.[7] ..... B68G 5/00
(52) U.S. Cl. ..... 248/118; 248/118.3
(58) Field of Search ..... 248/118, 118.1, 248/118.3, 118.5; 482/94, 133, 904, 908, 67; 5/658, 87.1; 601/1, 241

(56) References Cited

U.S. PATENT DOCUMENTS

| | | | | | |
|---|---|---|---|---|---|
| 3,189,345 | A | * | 6/1965 | Simpson | 428/67 |
| 4,685,670 | A | * | 8/1987 | Zinkin | 272/136 |
| 4,809,804 | A | * | 3/1989 | Houston | 180/65.5 |
| 4,913,423 | A | * | 4/1990 | Farran et al. | 272/134 |
| 4,976,387 | A | | 12/1990 | Spianti | 224/262 |

FOREIGN PATENT DOCUMENTS

| | | |
|---|---|---|
| EP | 0129361 | 12/1984 |
| FR | 974634 | 2/1951 |

* cited by examiner

*Primary Examiner*—Kimberly T. Nobu
*Assistant Examiner*—Gwendolyn Baxter
(74) *Attorney, Agent, or Firm*—Webb Ziesenheim Logsdon Orkin & Hanson, P.C.

(57) ABSTRACT

The invention relates to a force compensator for supplying a substantially constant force in a substantially fixed direction at a random point of a bounded space, which force compensator comprises a frame, a parallelogram-shaped rod system arranged pivotally thereon and two force-providing elements arranged with an end on the rod system, wherein at least one of the force-providing elements is arranged with the other end on the frame in order to compensate a constant force at the random point of the bounded space.

13 Claims, 5 Drawing Sheets

FORCE COMPENSATOR

BACKGROUND OF THE INVENTION

1. Field of the Invention

The invention relates to a force compensator for supplying a substantially constant force in a substantially fixed direction at a random point of a bounded space.

2. Description of the Prior Art

Known devices have the drawback that the compensating force can only be exerted on a path determined by the device. It is not therefore possible with this device to cause a force acting at a freely moving point in the space to be compensated by the device.

There are a large number of occupations wherein activities must be carried out with practically outstretched arms. Back, shoulder and arm complaints can certainly occur through muscle strain when these operations are performed for a prolonged period. Such activities can for instance be medical operations or the wiring of a wiring cabinet.

SUMMARY OF THE INVENTION

The invention has for its object to provide a device which obviates the above stated drawbacks.

This objective is achieved by a force compensator for supplying a substantially constant force in a substantially fixed direction at a random point of a bounded space, which force compensator comprises a frame, a parallelogram-shaped rod system arranged pivotally thereon and two force-providing elements arranged with an end on the rod system.

The advantage of the device according to the invention is that a constant force is exerted by the device at any point of the space bounded by the device. It is hereby possible to compensate a force, for instance a gravitational force, at any random point of the space bounded by the geometry of the device.

According to a preferred embodiment an arm support is arranged on the device. By now mounting the device on a seat or a table the user can allow his arms to be supported by the device, thus making it possible to perform work for long periods with practically outstretched arms. According to a specific embodiment of the invention the device is embodied such that two parallel arms are embodied as a tube and a rod running therein. This prevents objects or body parts being trapped between the two parallel arms during positioning.

BRIEF DESCRIPTION OF THE DRAWINGS

The invention will be further elucidated with reference to the annexed drawings.

DESCRIPTION OF THE PREFERRED EMBODIMENT

Figure 1:
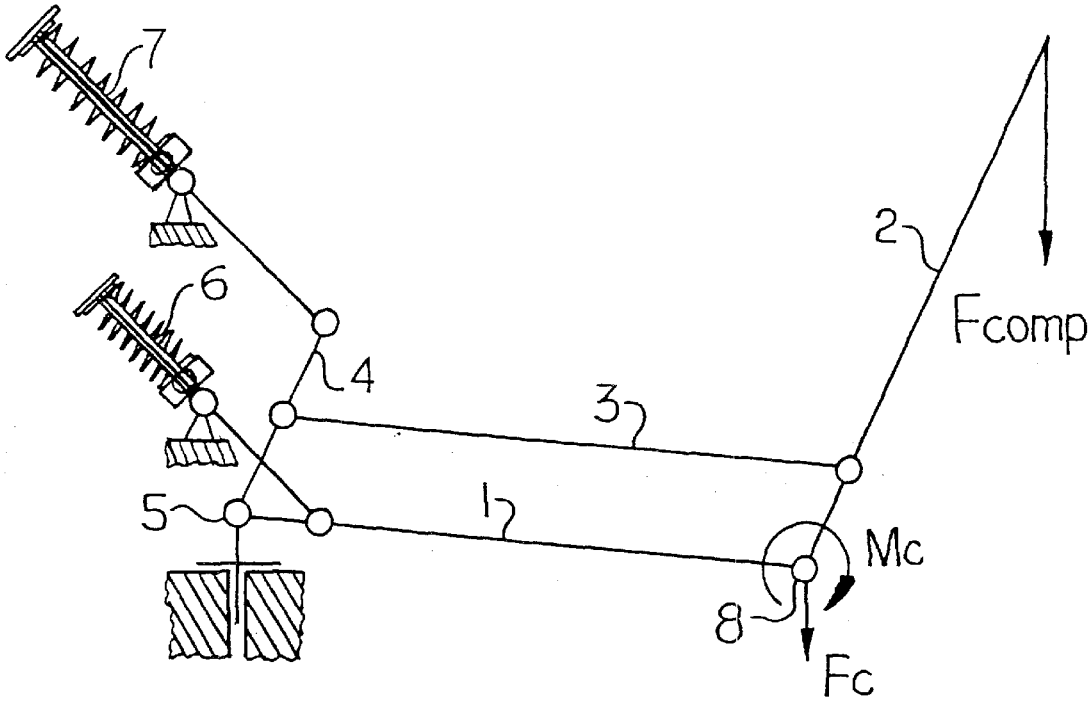
FIG. 1 shows a schematic view of the device according to the invention.

FIG. 1 shows the device according to the invention schematically. The device comprises a rod system consisting of an upper arm 1, a lower arm 2, a parallel rod 3 and a connecting rod 4. These parts are pivotally connected to each other such that they form a parallelogram-shaped rod system. This rod system is pivotally connected at pivot point 5 to a fixed component, for instance a seat or table. The device further comprises a first spring 6 and a second spring 7, which springs are arranged between a frame and upper arm 1 respectively connecting rod 4. Supposing that the force for compensating is applied to the outer end of lower arm 2, a force $F_c$ and a moment $M_c$ will then occur at pivot point 8 of the rod system as a result of the force. The force $F_c$ is then compensated by spring 6 and upper arm 1. The moment $M_c$ is compensated independently of force $F_c$ by spring 7 and the rod system. With an appropriate choice of the spring constant and the points of engagement a constant compensation force can be obtained at any point of the bounded space.

A prerequisite for obtaining a constant compensation force is that the springs used provide a force=0 at an effective length=0. The effective length is herein the distance between both points of engagement of the spring.

It is a further prerequisite for obtaining a constant compensation force that the springs used are linear springs. A linear spring has a fixed spring constant.

Figure 2:
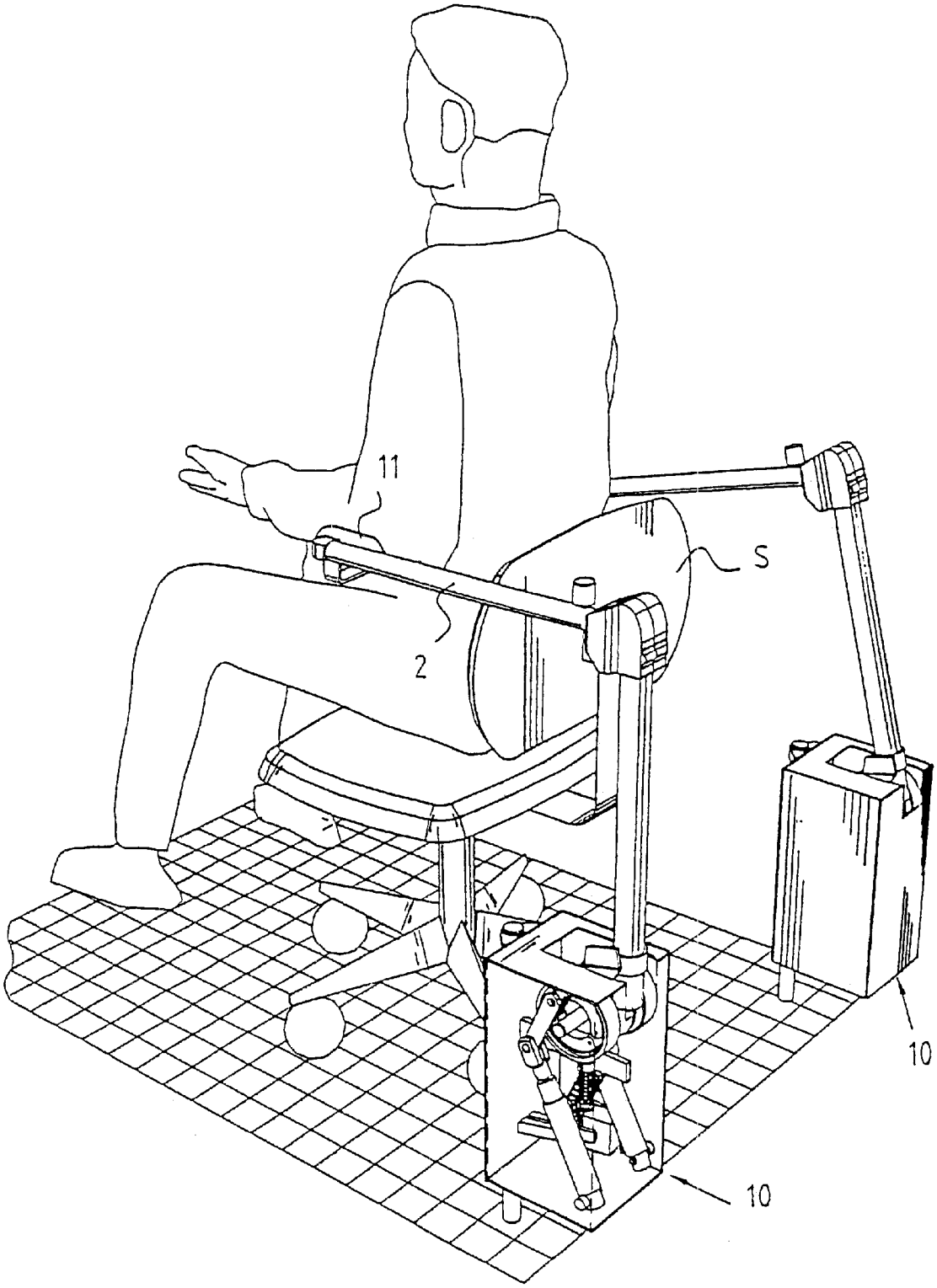
FIG. 2 is a perspective view of a practical embodiment according to the invention.

FIG. 2 shows an embodiment of the device according to the invention. The device 10 is arranged here behind seat S. Arranged on the free end of lower arm 2 is an arm shell 11 in which a person can lay his arm such that preferably the weight of this arm is partially compensated.

Figure 3:
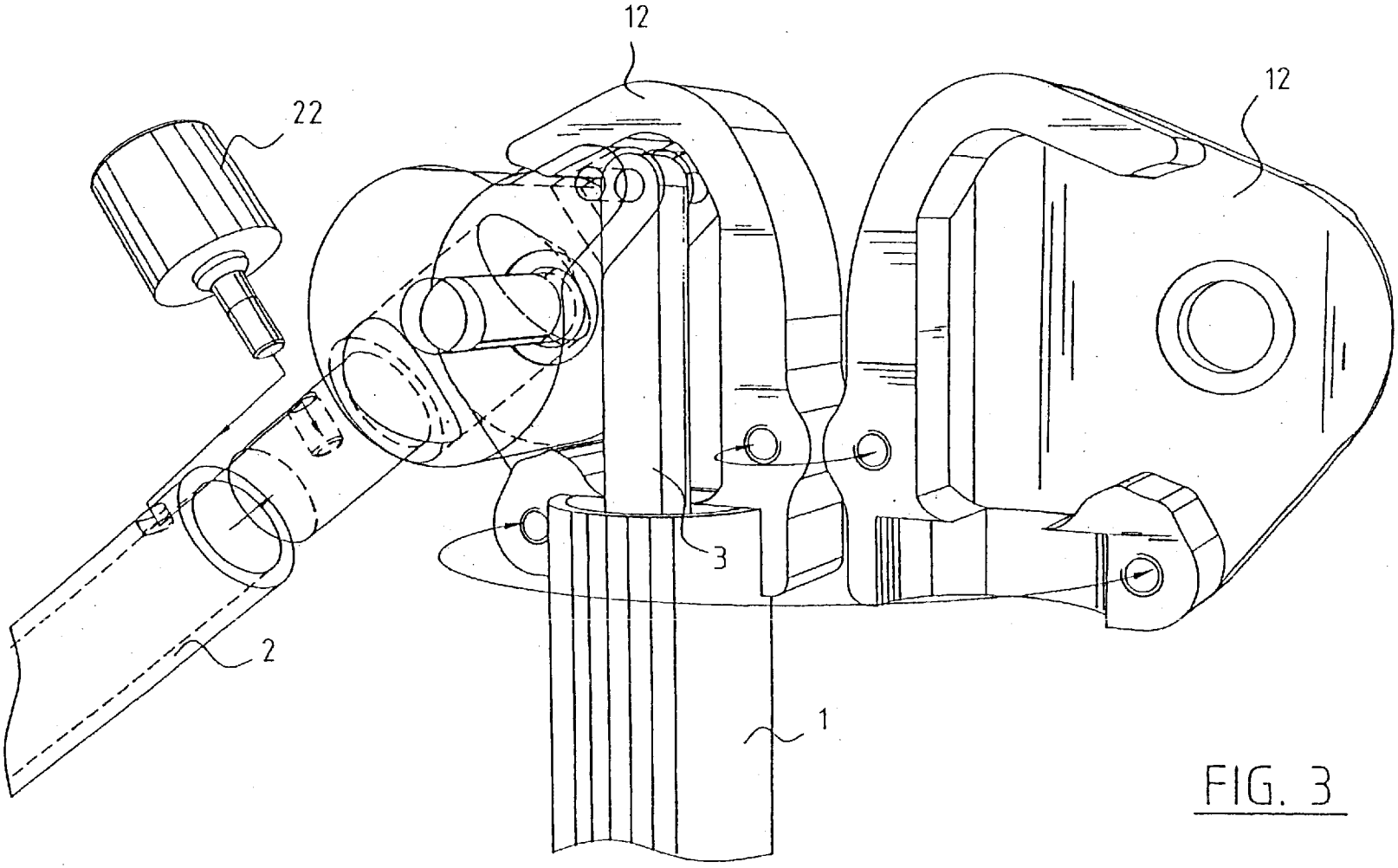
FIG. 3 shows a cross-section of a part of the preferred embodiment of FIG. 2.

FIG. 3 shows a cross-section of a part of the device of FIG. 2 in this embodiment the upper arm 1 is embodied as a tube through which runs parallel rod 3. Upper arm 1 and parallel rod 3 are both pivotally connected to lower arm 2 by means of a locking pin 22. For protection purposes a cap 12 is arranged over both pivot points.

Figure 5:
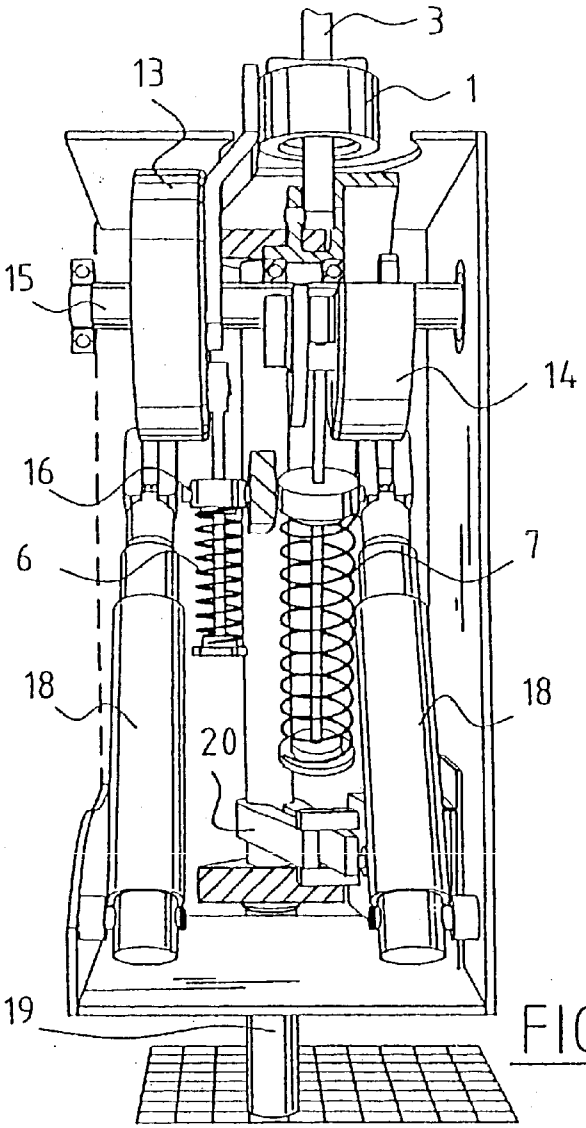
FIGS. 4 and 5 show a broken-away perspective view of a part of the device of FIG. 2.
Figure 4:
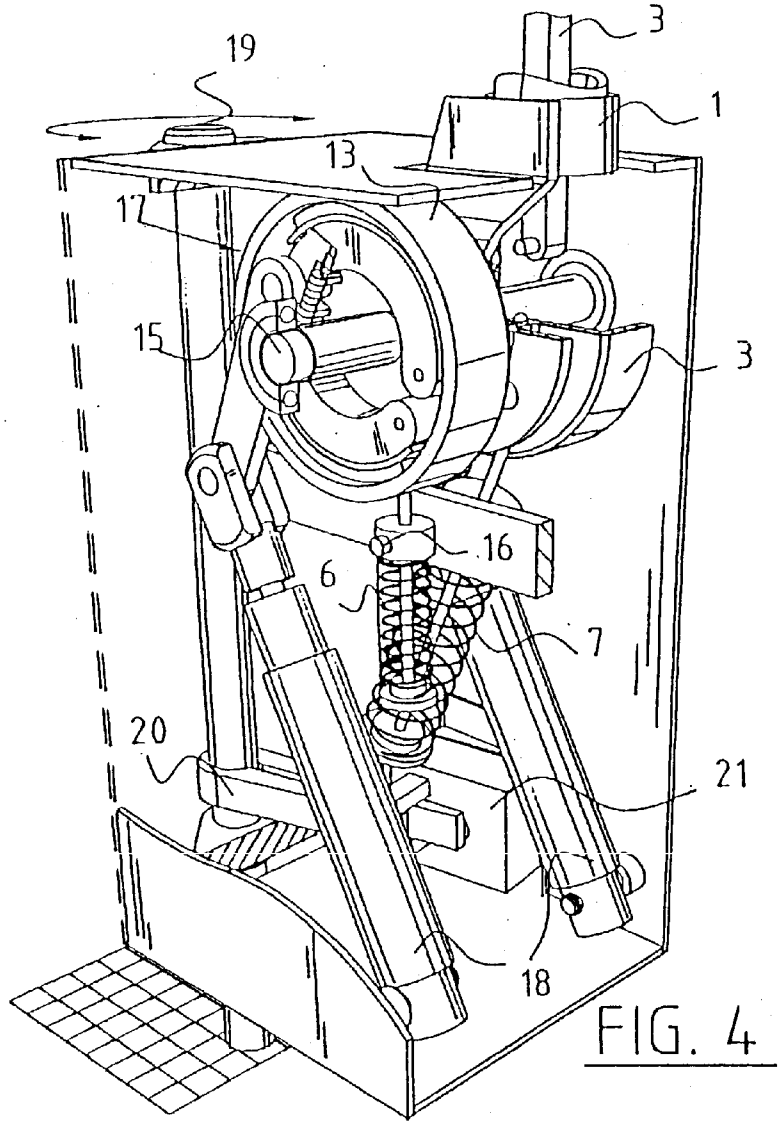

Upper arm 1 and parallel rod 3 are arranged pivotally on their other end on a disc 13 respectively 14 (see FIGS. 4 and 5). Both discs are mounted on a main shaft 15. This main shaft 15 forms the pivot 5 of FIG. 1. First spring 6 and second spring 7 are also arranged on the two discs. These springs 6, 7 are further connected to the frame of the device via a spring shaft 16. Drum brakes 17 of the same type as arranged on a cycle are further arranged in the discs, whereby the movements of the device can be blocked. These drum brakes 17 are each energized by a pneumatic cylinder 18. The device is pivotally connected via a shaft 19 to a fixed component, for instance a seat or table. This rotation can be blocked by means of the clamp 20 and pneumatic cylinder 21.

Figure 6:
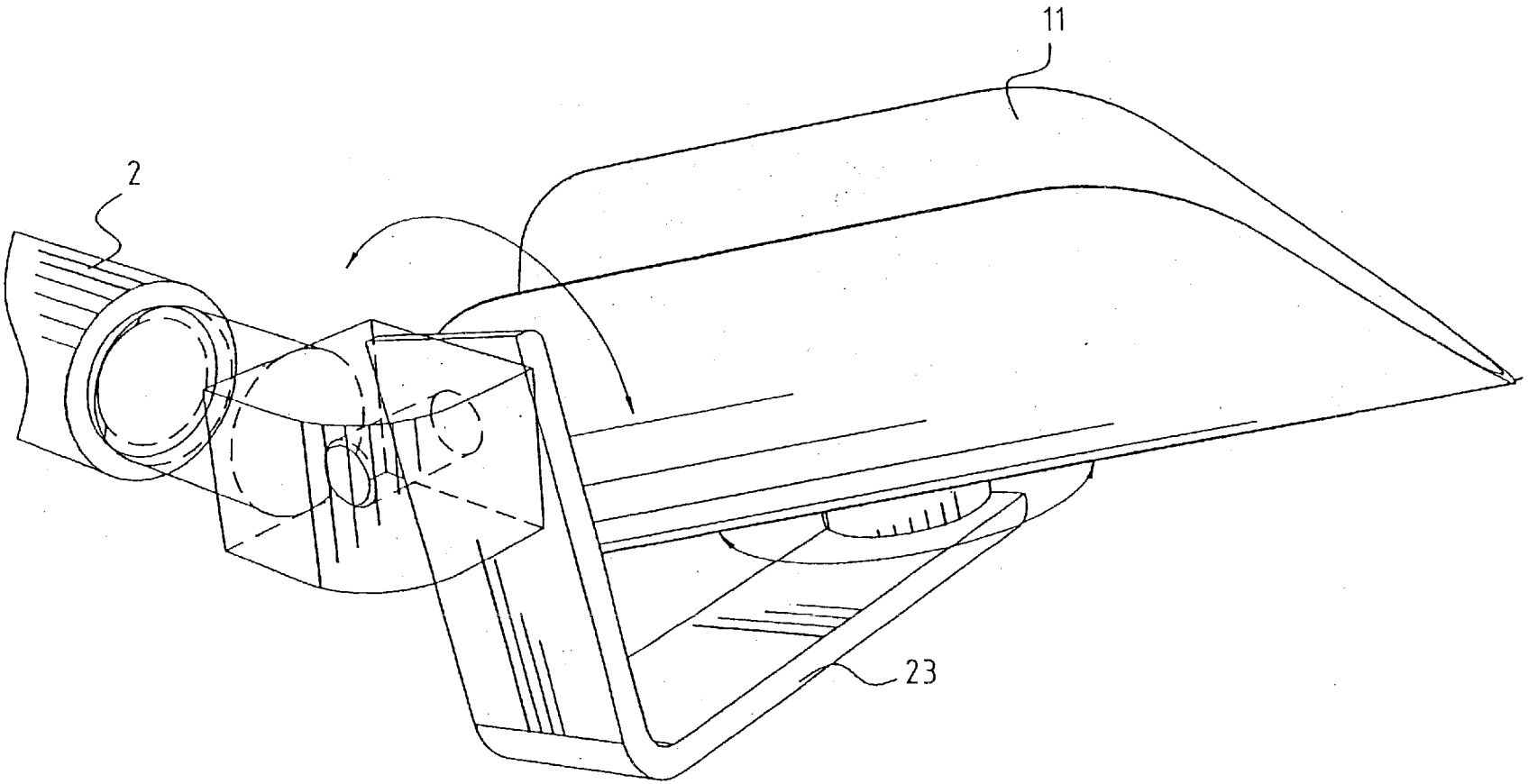
FIG. 6 is a perspective view of an arm shell according to the invention.

FIG. 6 shows the arm shell 11 which is connected to lower arm 2 for pivoting in two directions by means of an L-shaped bracket 23. The pivot axes preferably both extend through the centre of gravity of the arm for supporting. The arm shell can hereby be pivoted easily and very lightly.

The device according to the invention can also be applied in for instance a desk lamp. Hereby a very light, practically frictionless operation of the desk lamp is advantageously obtained, wherein the lamp likewise stands still in any desired position without the pivot points having to be fixed.

As an alternative embodiment, one of the springs can be arranged between two arms of the rod system. It is further possible to apply active springs comprising for instance a pneumatic cylinder, a force and displacement sensor and a computing unit. These active springs take up a determined position subject to the force exerted on the cylinder. It is hereby possible to influence the characteristic of the compensating force.

Figure 7:
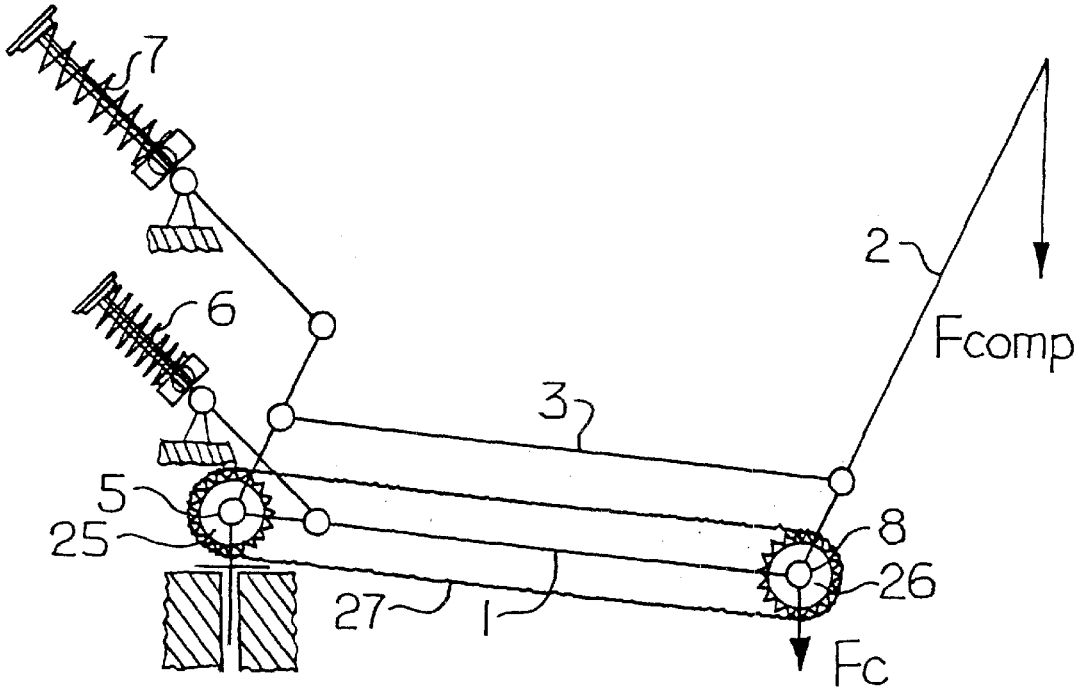
FIG. 7 is a schematic view of a further embodiment of the device according to the invention.

Instead of the four rods 1, 2, 3, 4 forming the parallelogram-shaped rod system, it is of course also possible to use for instance two chain wheels 25 and 26 which are mounted on a rod 1 and mutually connected by means of an endless chain 27. See FIG. 7.

What is claimed is:

1. A force compensator for supplying a substantially constant force in a substantially fixed direction at a random point of a bounded space in order to support a limb of a human, comprising a frame, a parallelogram-shaped rod system arranged pivotally thereon and a first force-providing element and a second force-providing element, each having an end on the rod system, wherein at least one of the first and second force-providing elements is arranged with the other end on the frame, and a support arranged on the rod system and configured to support the limb of the human, wherein the first force-providing element and the second force-providing element each comprise a spring.

2. The force compensator as claimed in claim 1, wherein the rod system includes a first pair of substantially parallel rods and a second pair of substantially parallel rods, which rods are mutually connected by means of pivots for pivoting in one plane, wherein the rods are bounded by the pivots, the first force-providing element is connected to a first rod connected pivotally to the frame of the first pair and the second force-providing element is connected to a first rod connected pivotally to the frame of the second pair.

3. The force compensator as claimed in claim 2, wherein at least the second rod of the second pair extends beyond the rods of the first pair.

4. The force compensator as claimed in claim 3, wherein the support is arranged pivotally on the outer end of the second rod of the second pair.

5. The force compensator as claimed in claim 4, wherein pivoting lines of the support substantially intersect the center of gravity of the limb supported by the support.

6. The force compensator as claimed in claim 1, wherein at an effective length equal to zero the force-providing elements supply a force equal to zero.

7. The force compensator as claimed in claim 1, wherein the force-providing elements are linear springs with a spring constant greater than zero.

8. The force compensator as claimed in claim 1, wherein the force-providing elements are active springs.

9. The force compensator as claimed in claim 1, further including blocking means for fixing in a position.

10. The force compensator as claimed in claim 9, wherein the blocking means are pneumatically controllable brakes.

11. The force compensator as claimed in claim 1, wherein the parallelogram-shaped rod system includes two chain wheels mounted on a rod and an endless chain running over the chain wheels.

12. A force compensator for supplying a substantially constant force in a substantially fixed direction at a random point of a bounded space in order to support a limb of a human, comprising a frame, a parallelogram-shaped rod system arranged pivotally thereon and a first force-providing element and a second force-providing element, each having an end on the rod system, wherein at least one of the first and second force-providing elements is arranged with the other end on the frame, a support arranged on the rod system and blocking means for fixing in a position, wherein the blocking means are pneumatically controllable breaks.

13. A force compensator for supplying a substantially constant force in a substantially fixed direction at a random point of a bounded space in order to support a limb of a human, comprising a frame, a parallelogram-shaped rod system arranged pivotally thereon and a first force-providing element and a second force-providing element, each having an end on the rod system, wherein at least one of the first and second force-providing elements is arranged with the other end on the frame, and a support arranged on the rod system, wherein the parallelogram-shaped rod system includes two chain wheels mounted on a rod and an endless chain running over the chain wheels.

* * * * *